US006736764B1

(12) United States Patent
Kapustka

(10) Patent No.: US 6,736,764 B1
(45) Date of Patent: May 18, 2004

(54) DEVICE FOR TRAINING A MARTIAL ARTIST TO KICK

(76) Inventor: Stephen Kapustka, 1720 Yennecott Dr., Southold, NY (US) 11971

( * ) Notice: Subject to any disclaimer, the term of this patent is extended or adjusted under 35 U.S.C. 154(b) by 318 days.

(21) Appl. No.: 09/950,296

(22) Filed: Sep. 10, 2001

(51) Int. Cl.[7] ..... A63B 21/00
(52) U.S. Cl. ..... 482/83; 482/87; 482/90
(58) Field of Search ..... 482/83–90, 148, 482/907

(56) References Cited

U.S. PATENT DOCUMENTS 1,733,709 A * 10/1929 Zinnow et al.
4,662,630 A 5/1987 Dignard et al. ..... 272/76
4,817,941 A 4/1989 McCorry ..... 272/76
D356,127 S 3/1995 Mara ..... D21/191
5,460,343 A * 10/1995 Hestilow
5,722,920 A 3/1998 Bauer ..... 482/83
5,863,278 A * 1/1999 Chen
5,899,835 A 5/1999 Puranda ..... 482/90
5,921,895 A 7/1999 Lynch et al. ..... 482/83
6,220,992 B1 * 4/2001 Shafik
6,348,028 B1 * 2/2002 Cragg

* cited by examiner

*Primary Examiner*—Jerome W. Donnelly
(74) *Attorney, Agent, or Firm*—Richard L. Miller

(57) ABSTRACT

A device that trains a martial artist to kick. The device includes a stand and a target. The target extends adjustably outwardly from the stand and is kicked by the martial artist to train the martial artist to kick. The stand includes a base and a post with a lower end having a mortise therein. The base is T-shaped and includes a pair of separate members. Each member has a tongue. The tongues are abutted against each other and received in the mortise in the post, and in so doing, the pair of separate members are held together in the post and the post extends upwardly from the base. The target includes a collar that replaceably encircles the post and has at least one coil spring extending radially outwardly from respective sides thereof that engages a cushion to be kicked by the martial artist.

57 Claims, 1 Drawing Sheet

DEVICE FOR TRAINING A MARTIAL ARTIST TO KICK

BACKGROUND OF THE INVENTION

1. Field of the Invention

The present invention relates to a device. More particularly, the present invention relates to a device for training a martial artist to kick.

2. Description of the Prior Art

Numerous innovations for martial arts practicing devices have been provided in the prior art that will be described. Even though these innovations may be suitable for the specific individual purposes to which they address, however, they differ from the present invention.

A FIRST EXAMPLE, U.S. Pat. No. Des. 356,127 to Mara teaches the ornamental design for martial arts practice stand.

A SECOND EXAMPLE, U.S. Pat. No. 4,662,630 to Dignard et al. teaches a martial arts striking apparatus including a striking board and mounting apparatus for mounting the striking board at different vertical heights and at different angles with respect to the vertical and for mounting the striking board resiliently whereby the board will pivot in response to a received blow and will thereafter be returned to its initial position.

A THIRD EXAMPLE, U.S. Pat. No. 4,817,941 to McCorry teaches an adjustable target holder for martial arts training that has a base, a vertical support post and an elongated bi-sectional arm. The first arm is hollow, is slidably attached to the post, and has an open distal end. The second arm is solid and includes an extension received in the first arm's hollow interior. The second arm extension rotates inside the first arm. The second arm is rotated and locked into a selected position by means of a push button and follower detent which is urged into one of a series of depressions in the first arm's interior. The second arm's distal end includes a chamber into which a target end is placed. The target end is held firmly in the second arm by wedges which are positioned by a rack and pinion. When a handle operably connected to the rack and pinion is turned, the wedges move to hold the target. The second arm is then rotated into a desired position, supporting the board horizontally, vertically, or diagonally.

A FOURTH EXAMPLE, U.S. Pat. No. 5,722,920 to Bauer teaches a martial arts practice apparatus comprising a support member. A facility is for positioning the support member vertically in a stationary manner. At least one target member is provided. A structure is for suspending the at least one target member outwardly from the support member in a height adjustable manner. An assemblage between the suspending structure and the at least one target member is for returning the at least one target member back to its original position after being struck and ticked by a martial artist.

A FIFTH EXAMPLE, U.S. Pat. No. 5,899,835 to Puranda teaches a multifunctional training device comprising a base adapted to be placed upon a horizontal support surface. A stanchion is also provided. A main coil spring has two ends. The first end is fixedly attached to the base, while the second end is fixedly attached to the stanchion. A body bag unit is removably attachable onto the stanchion to receive strikes from a trainee. A punching bag striking unit is removably attachable onto a top end of the stanchion to receive strikes from the trainee.

A SIXTH EXAMPLE, U.S. Pat. No. 5,921,895 to Lynch et al. teaches a martial arts striking device using a pair of spaced and heavy duty spring assemblies with a top bracket having a centered opening for receiving an upright post supporting a resilient striking bag. The lower ends of the spring assemblies are secured to a bottom bracket, which is fastened to a firm footing such as a floor. The wire making up the springs are of such a diameter that the springs have a low spring constant, meaning the springs are highly resistive to impacts against the bag and will return to an upright position without undue oscillation.

It is apparent that numerous innovations for martial arts practicing devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a device for training a martial artist to kick that avoids the disadvantages of the prior art.

ANOTHER OBJECT of the present invention is to provide a device for training a martial artist to kick that is simple and inexpensive to manufacture.

STILL ANOTHER OBJECT of the present invention is to provide a device for training a martial artist to kick that is simple to use.

BRIEFLY STATED, STILL YET ANOTHER OBJECT of the present invention is to provide a device that trains a martial artist to kick. The device includes a stand and a target. The target extends adjustably outwardly from the stand and is kicked by the martial artist to train the martial artist to kick. The stand includes a base and a post with a lower end having a mortise therein. The base is T-shaped and includes a pair of separate members. Each member has a tongue. The tongues are abutted against each other and received in the mortise in the post, and in so doing, the pair of separate members are held together in the post and the post extends upwardly from the base. The target includes a collar that replaceably encircles the post and has at least one coil spring extending radially outwardly from respective sides thereof that engages a cushion to be kicked by the martial artist.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figures 1, 2, 3, 4:
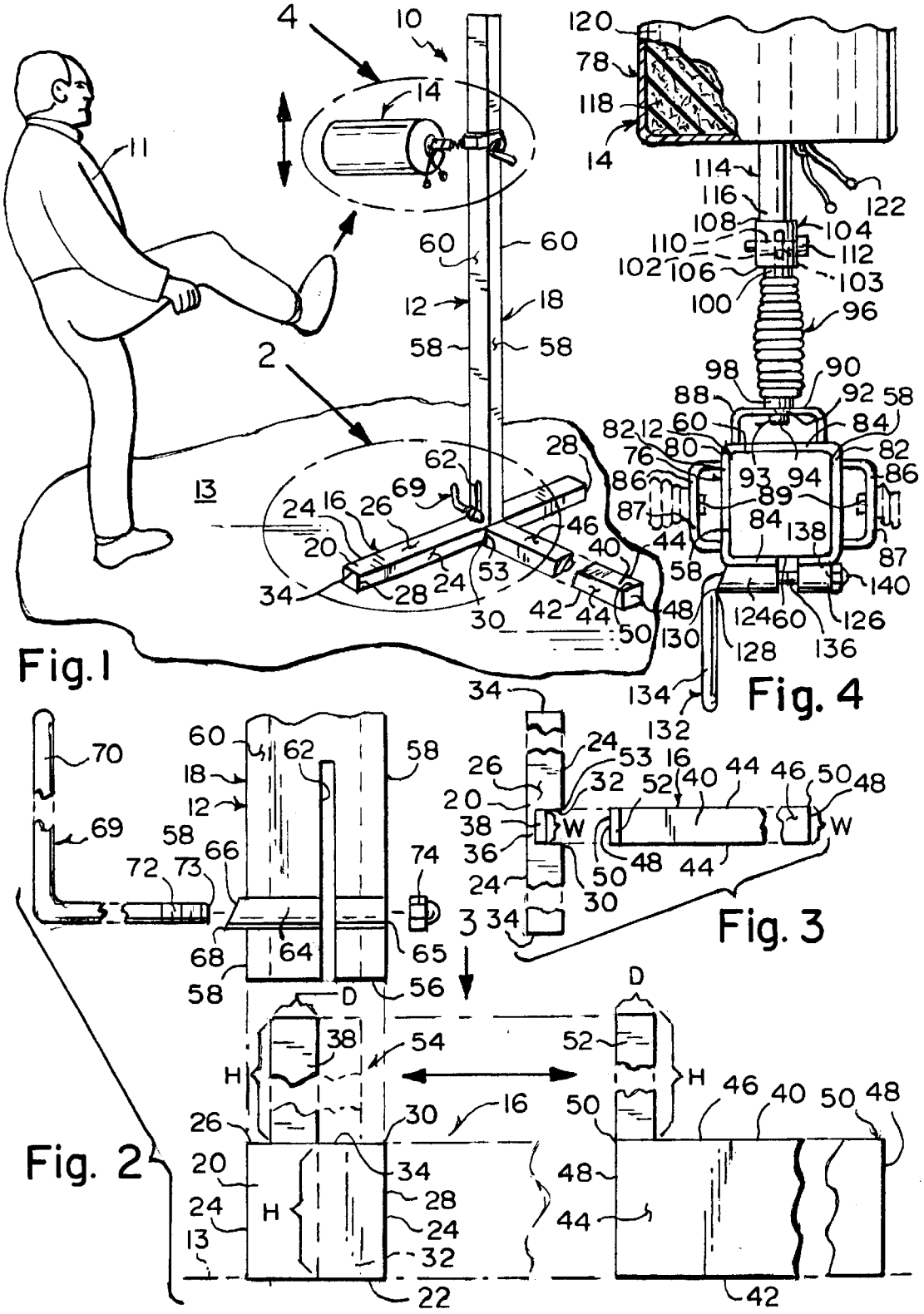
FIG. 1 is a diagrammatic perspective view of the present invention in use.
FIG. 2 is an enlarged exploded diagrammatic front elevational view of the area generally enclosed by the dotted curve identified by ARROW 2 in FIG. 1.
FIG. 3 is a diagrammatic top plan view taken generally in the direction of ARROW 3 in FIG. 3.
FIG. 4 is an enlarged diagrammatic top plan view of the area generally enclosed by the dotted curve identified by ARROW 4 in FIG. 1.

| | |
|---|---|
| D | depth of tongue 38 of first member 20 of base 16 of stand 12 |
| D | depth of tongue 52 of second member 40 of base 16 of stand 12 |
| H | height of groove 32 in first member 20 of base 16 of stand 12 |
| H | height of tongue 38 of first member 20 of base 16 of stand 12 |
| H | height of second member 40 of base 16 of stand 12 |
| H | height of tongue 52 of second member 40 of base 16 of stand 12 |
| W | width of groove 32 in first member 20 of base 16 of stand 12 |
| W | width of tongue 38 of first member 20 of base 16 of stand 12 |
| W | width of second member 40 of base 16 of stand 12 |
| W | width of tongue 52 of second member 40 of base 16 of stand 12 |
| 10 | device of present invention for training martial artist 11 to kick |
| 11 | martial artist |
| 12 | stand for extending upwardly from floor 13 |
| 13 | floor |
| 14 | target for kicking by martial artist so as to train martial artist to kick |
| 16 | base of stand 12 for resting on floor 13 |
| 18 | post of stand 12 |
| 20 | first member of base 16 of stand 12 for resting on floor 13 |
| 22 | lowermost surface of first member 20 of base 16 of stand 12 for resting on floor 13 |
| 24 | pair of side surfaces of first member 20 of base 16 of stand 12 |
| 26 | uppermost surface of first member 20 of base 16 of stand 12 |
| 28 | pair of terminal ends of one side surface of pair of side surfaces 24 of first member 20 of base 16 of stand 18 |
| 30 | center of one side surface of pair of side surfaces 24 of first member 20 of base 16 of stand 18 |
| 32 | groove in first member 20 of base 16 of stand 12 |
| 34 | pair of terminal ends of top surface 26 of first member 20 of base 16 of stand 18 |
| 36 | center of top surface 26 of first member 20 of base 16 of stand 18 |
| 38 | tongue of first member 20 of base 16 of stand 12 |
| 40 | second member of base 16 of stand 12 for resting on floor 13 |
| 42 | lowermost surface of second member 40 of base 16 of stand 12 for resting on floor 13. |
| 44 | pair of side surfaces of second member 40 of base 16 of stand 12 |
| 46 | uppermost surface of second member 40 of base 16 of stand 12 |
| 48 | pair of ends of second member 40 of base 16 of stand 12 |
| 50 | pair of terminal ends of top surface 46 of second member 40 of base 16 of stand 12 |
| 52 | tongue of second member 40 of base 16 of stand 12 |
| 53 | intersection point of base 16 of stand 12 |
| 54 | combination tongue of base 16 of stand 12 |
| 56 | lowermost end of post 18 of stand 12 |
| 58 | first pair of opposing side surfaces of post 18 of stand 12 |
| 60 | second pair of opposing side surfaces of post 18 of stand 12 |
| 62 | throughslot through second pair of opposing side surfaces 60 of post 18 of the stand 12 |
| 64 | tube of post 18 of stand 12 |
| 65 | one end of tube 64 of post 18 of stand 12 |
| 66 | free end of tube 64 of post 18 of stand 12 |
| 68 | far point of free end 66 of tube 64 of post 18 of stand 12 |
| 69 | grip of post 18 of stand 12 |
| 70 | handle of grip 69 of post 18 of stand 12 |
| 72 | screw of grip 69 of post 18 of stand 12 |
| 73 | free end of screw 72 of grip 69 of post 18 of stand 12 |
| 74 | nut of grip 69 of post 18 of stand 12 |

-continued

LIST OF REFERENCE NUMERALS UTILIZED IN THE DRAWING

| | |
|---|---|
| 76 | collar of target 14 |
| 78 | at least one bag of target 14 |
| 80 | slender band of collar 76 of target 14 |
| 82 | first pair of opposing side walls of collar 76 of target 14 |
| 84 | second pair of opposing side walls of collar 76 of target 14 |
| 86 | first pair of brackets of collar 76 of target 14 |
| 87 | transverse portions 87 of first pair of opposing side walls 82 of collar 76 of target 14, respectively |
| 88 | second bracket of collar 76 of target 14 |
| 89 | throughbores through transverse portions 87 of first pair of brackets 86 of collar 76 of target 14, respectively |
| 90 | transverse portion of second bracket 88 of collar 76 of target 14 |
| 92 | throughbore through transverse portion 90 of second bracket 88 of collar 76 of target 14 |
| 93 | first fastener of at least one bag 78 of target 14 |
| 94 | head of first fastener 93 of at least one bag 78 of target 14 |
| 96 | coil spring of at least one bag 78 of target 14 |
| 98 | first end of coil spring 96 of at least one bag 78 of target 14 |
| 100 | second end of coil spring 96 of at least one bag 78 of target 14 |
| 102 | second fastener of at least one bag 78 of target 14 |
| 103 | throughbore through second fastener of at least one bag 78 of target 14 |
| 104 | coupling of at least one bag 78 of target 14 |
| 106 | first end of coupling 104 of at least one bag 78 of target 14 |
| 108 | second end of coupling 104 of at least one bag 78 of target 14 |
| 110 | throughbore through coupling 104 of at least one bag 78 of target 14 |
| 112 | pin of at least one bag 78 of target 14 |
| 114 | rod of at least one bag 78 of target 14 |
| 116 | first end of rod 114 of at least one bag 78 of target 14 |
| 118 | cushion of at least one bag 78 of target 14 |
| 120 | covering completely encasing cushion 118 of at least one bag 78 of target 14 |
| 122 | pull cord of covering 120 of at least one bag 78 of target 14 |
| 124 | tube of collar 76 of target 14 |
| 126 | one end of tube 124 of collar 76 of target 14 |
| 128 | free end of tube 124 of collar 76 of target 14 |
| 13e | far point of free end 128 of tube 124 of collar 76 of target 14 |
| 132 | grip of collar 76 of target 14 |
| 134 | handle of grip 132 of collar 76 of target 14 |
| 136 | screw of grip 132 of collar 76 of target 14 |
| 138 | free end of screw 136 of grip 132 of collar 76 of target 14 |
| 140 | nut of grip 132 of collar 76 of target 14 |

DETAILED DESCRIPTION OF THE PREFERRED EMBODIMENT

Referring now to the figures, in which like numerals indicate like parts, and particularly to FIG. 1, the device of the present invention is shown generally at 10 for training a martial artist 11 to kick.

The overall configuration of the device 10 can best be seen in FIG. 1, and as such, will be discussed with reference thereto.

The device 10 comprises a stand 12 for extending upwardly from a floor 13, and a target 14 that extends adjustably outwardly from the stand 12 and is for kicking by the martial artist so as to train the martial artist to kick.

The specific configuration of the stand 12 can best be seen in FIGS. 1–3, and as such, will be discussed with reference thereto.

The stand 12 comprises a base 16 for resting on the floor 13, and a post 18 that extends replaceably upwardly from the base 16 of the stand 12.

The base 16 of the stand 12 is T-shaped.

The base 16 of the stand 12 comprises a first member 20 that is slender, elongated, and rectangular-parallelepiped-shaped, and is for resting on the floor 13.

The first member 20 of the base 16 has a lowermost surface 22 that is horizontally-oriented and is for resting on the floor 13, a pair of side surfaces 24 that are vertically-oriented and extend upwardly from the lowermost surface 22 of the first member 20, a height, and an uppermost surface 26 that is horizontally-oriented.

One side surface 24 of the first member 20 of the base 16 has a pair of terminal ends 28, and a center 30 that is located midway between the pair of terminal ends 28 of the one side surface 24 of the first member 20.

The first member 20 of the base 16 has a groove 32 that is disposed in the center 30 of the one side surface 24 of the first member 20

The groove 32 in the first member 20 of the base 16 is vertically-oriented, rectangular-parallelepiped-shaped, and has a width W.

The groove 32 in the first member 20 of the base 16 extends vertically from, and opens into, the lowermost surface 22 of the first member 20 of the base 16, to, and opens into, the uppermost surface 26 of the first member 20 of the base 16, and horizontally to, midway between the pair of side surface 24 of the first member 20 of the base 16.

The top surface 26 of the first member 20 of the base 16 has a pair of terminal ends 34, and a center 36 that is located midway between the pair of terminal ends 34 of the top surface 26 of the first member 20.

The first member 20 of the base 16 has a tongue 38 that extends upwardly from the center 36 of the top surface 26 of the first member.

The tongue 38 on the first member 20 of the base 16 is vertically-oriented, rectangular-parallelepiped-shaped, and has a width W, a height H, and a depth D.

The tongue 38 on the first member 20 of the base 16 extends horizontally from flush with the groove 32 in the first member 20 of the base 16, to short of the other side surface 24 of the first member 20 of the base 16.

The width W of the tongue 38 on the first member 20 of the base 16 is equal to the width W of the groove 32 in the first member 20 of the base 16.

The base 16 of the stand 12 further comprises a second member 40 that is slender, elongated, and rectangular-parallelepiped-shaped, and is for resting on the floor 13.

The second member 40 of the base 16 has a lowermost surface 42 that is horizontally-oriented and is for resting on the floor 13, a pair of side surfaces 44 that are vertically-oriented and extend upwardly from the lowermost surface 42 of the second member 40, an uppermost surface 46 that is horizontally-oriented, a width W, a height H, and a pair of ends 48.

The width W of the second member 40 of the base 16 is equal to the width W of the groove 32 in the first member 20 of the base 16.

The height H of the second member 40 of the base 16 is equal to the height H of the groove 32 in the first member 20 of the base 16.

The top surface 46 of the second member 40 of the base 16.has a pair of terminal ends 50.

The second member 40 of the base 16 has a tongue 52 that extends upwardly from one terminal end 50 of the top surface 46 of the second member.

The tongue 52 on the second member 40 of the base 16 is vertically-oriented, rectangular-parallelepiped-shaped, and has a width W, a height H, and a depth D.

The tongue 52 on the second member 40 of the base 16 extends horizontally from one side surface 44 of the second member 40 of the base 16, to the other side surface 44 of the second member 40 of the base 16, and is flush with the one end 48 of the second member 40 of the base 16.

The width W of the tongue 52 on the second member 40 of the base 16 is equal to the width W of the tongue 38 on the first member 20 of the base 16.

The height H of the tongue 52 on the second member 40 of the base 16 is equal to the height H of the tongue 38 on the first member 20 of the base 16.

The depth D of the tongue 52 on the second member 40 of the base 16 is equal to the depth D of the tongue 38 on the first member 20 of the base 16.

The one end 48 of the second member 40 of the base 16 replaceably enters into, and fills completely, the groove 32 in the first member 20 of the base 16 so as to allow the second member 40 of the base 16 to be perpendicular to, and form an intersection point 53 with, the first member 20 of the base 16, and in so doing, abuts the tongue 52 on the second member 40 of the base 16 flush with the tongue 38 on the first member 20 of the base 16 so as to form a combination tongue 54, and when done, the tongue 52 on the second member 40 of the base 16 extends to short of the one side surface 28 of the first member 20 of the base 16 an amount equal to that that the tongue 38 on the first member 20 of the base 16 extends short of the other side surface 28 of the first member 20 of the base 16, and in so doing, centers the combination tongue 54 on the intersection point 53 of the base 16, by virtue of the groove 32 in the first member 20 of the base 16 extending halfway into the first member 20 of the base 16, the tongue 38 on the first member 20 of the base 16 extending therefrom to short of the other side surface 28 of the first member 20 of the base 16, and the depth D of the tongue 38 on the first member 20 of the base 16 being equal to the depth D of the tongue 52 on the second member 40 of the base 16.

The post 18 of the stand 12 extends replaceably upwardly from the intersection point 53 of the base 16.

The post 18 of the stand 12 is slender, elongated, rectangular-parallelepiped-shaped, and extends upwardly from the base 16 of the stand 12.

The post 18 of the stand 12 has a lowermost end 56 that is horizontally-oriented, a first pair of opposing side surfaces 58 that are vertically-oriented and extend upwardly from the lowermost end 56 of the post 18, and a second pair of opposing side surfaces 60 that are vertically-oriented, extend upwardly from the lowermost end 56 of the post 18, and are perpendicular to the first pair of opposing surfaces 58 of the post 18.

The lowermost end 56 of the post 18 is hollow so as to receive the combination tongue 53, and when done, the post 18 extends vertically upwardly from the base 16.

The lowermost end 56 of the post 18 has a throughslot 62 that extends through the second pair of opposing side surfaces 60 of the post 18, approximately midway between the first pair of opposing side surfaces 58 of the post 18.

The post 18 has a tube 64 that is affixed across one second opposing side surface 60 of the post 18, and extends, at one end 65 thereof, from flush with one first opposing side surface 58 of the post 18, to, at a free end 66 thereof, just past the other first opposing side surface 58 of the post 18.

The free end 66 of the tube 64 is skewed so as to have a far point 68.

The post 18 has a grip 69 that is slender, elongated, and L-shaped.

The grip 69 of the post 18 has a handle 76 and a screw 72 that is perpendicular to the handle 70 of the grip 69 of the post 18.

The screw 72 of the grip 69 of the post 18 extends freely into the tube 64 of the post 18, from the free end 66 of the tube 64, to past the one end 65 of the tube 66, and at a free end 73 thereof, engages a nut 74, and when the lowermost end 56 of the post 18 receives the combination tongue 53, and the handle 70 of the grip 69 of the post 18 is free of the far point 68 of the tube 64, the nut 74 of the grip 69 of the post 18 is tightened causing the throughslot 62 in the post 18 to compress and secure the post 18 onto the base 16, and when done, the handle 70 of the grip 69 of the post 18 is turned until it abuts against the far point 68 of the tube 64, and when done, an outward pressure is created on the handle 70 of the grip 69 of the post 18 that prevents the grip 69 from unintentional rotation.

The nut 74 of the grip 69 of the post is an acorn nut so as to completely cover the free end 73 of the screw 72 and prevent the free end 73 of the screw 72 from injuring anyone unintentionally engaging it.

The specific configuration of the target 14 can best be seen in FIG. 4, and as such, will be discussed with reference thereto.

The target 14 comprises a collar 76 that conformingly encircles the post 12 of the stand 12, and at least one bag 78 that extends radially outwardly from the collar 76 of the target 14.

The collar 76 of the target 14 is a slender band 80.

The collar 76 of the target 14 has a first pair of opposing side walls 82 that are horizontally-oriented and directly contact the first pair of opposing side surfaces 58 of the post 18, respectively, and a second pair of opposing side walls 84 that are horizontally-oriented, directly contact the second pair of opposing side surfaces 60 of the post 18, respectively, and are perpendicular to the first pair of opposing walls 82 of the collar 76.

One second opposing side wall 84 of the collar 76 that is in direct contact with the one second opposing side surface 60 of the post 18 is discontinuous.

The collar 76 of the target 14 has a first pair of brackets 86 that are horizontally-oriented, C-shaped, and extend outwardly from, and across, at transverse portions 87 thereof, the first pair of opposing side walls 82 of the collar 76, respectively.

The transverse portions 87 of the first pair of brackets 86 have throughbores 89 that extend centrally therethrough, respectively.

The collar 76 of the target 14 has a second bracket 88 that is horizontally-oriented, C-shaped, and extends outwardly from, and across, at a transverse portion 90 thereof, the other second opposing side wall 84 of the collar 76.

The transverse portion 90 of the second bracket 88 has a throughbore 92 that extends centrally therethrough.

The at least one bag 78 of the target 14 extends from any one of the first pair of brackets 86 of the collar 76 and the second bracket 88, and when the at least one bag 78 of the target 14 is more than one, the more than one bag of the target 14 extend from any combination of the first pair of brackets 86 of the collar 76 and the second bracket 88, respectively.

The at least one bag 78 of the target 14 comprises a first fastener 93 that is horizontally-oriented and extends radially outwardly through an associated one of the throughbores 89 in the first pair of brackets and the throughbore 92 in the second bracket 88, and is prevented from extending completely therethrough by a head 94 of the first fastener 93.

The at least one bag 78 of the target 14 comprises a coil spring 96 that is affixed, at a first end 98 thereof, to the first fastener 93 of the at least one bag 78.

The at least one bag 78 of the target 14 comprises a second fastener 102 that is affixed to, and extends axially from, a second end 100 of the coil spring 96.

The second fastener 102 of the at least one bag 78 has a throughbore 103 that extends transversely therethrough.

The at least one bag 78 of the target 14 comprises a coupling 104 that is tubular, and receives axially, at a first end 106 thereof, the second fastener 102 of the at least one bag 78, and extends axially therefrom, to a second end 108 thereof.

The coupling 104 of the at least one bag 78 has a throughbore 110 that extends transversely therethrough and is aligned with the throughbore 103 in the second fastener 102 of the at least one bag 78.

The second fastener 102 of the at least one bag 78 is selectively maintained in the first end 106 of the coupling 104 of the at least one bag 78 by a pin 112 that replaceably enters into the throughbore 110 in the coupling 104 of the at least one bag 78 and the throughbore 103 in the second fastener 102 of the at least one bag 78.

The at least one bag 78 comprises a rod 114 that has a first end 116 affixed in, for movement with, the second end 108 of the coupling 104 of the at least one bag 78.

The rod 114 of the at least one bag 78 extends axially from the coupling 104 of the at least one bag 78.

The at least one bag 78 comprises a cushion 118 that is cylindrically-shaped and axially receives the rod 114 of the at least one bag 78 centrally therethrough for movement therewith.

The cushion 118 of the at least one bag 78 is spaced from the coupling 104 of the at least one bag 78.

The cushion 118 of the at least one bag 78 is completely encased in a covering 120 that conforms to the cushion 118 of the at least one bag 78.

The covering 120 of the cushion 118 is made of a fabric.

The covering 120 of the cushion 118 is replaceably maintained on the cushion 118 of the at least one bag 78 by a pull cord 122.

The collar 76 has a tube 124 that is discontinuous and is affixed across the one second opposing side wall 84 of the collar 76, and extends, at one end 126 thereof, from flush with one first opposing side wall 82 of the collar 76, to, at a free end 128 thereof, just past the other first opposing side wall 82 of the collar 76.

The discontinuation of the tube 124 of the collar 124 is aligned with the discontinuation of the one second opposing side wall 84 of the collar 76.

The free end 128 of the tube 124 of the collar 76 is skewed so as to have a far point 130.

The collar 76 has a grip 132 that is slender, elongated, and L-shaped.

The grip 132 of the collar 76 has a handle 134 and a screw 136 that is perpendicular to the handle 134 of the grip 132 of the collar 76.

The screw 136 of the grip 132 of the collar 76 extends freely into the tube 124 of the collar 76, from the free end 128 of the tube 64 of the collar 76, to past the one end 126 of the tube 124 of the collar 76, and at a free end 138 thereof, engages a nut 140, and when the collar 76 receives the post 18, and the handle 134 of the grip 132 of the collar 76 is free of the far point 130 of the tube 124 of the collar 76, the nut 140 of the grip 132 of the collar 76 is tightened causing the discontinuation of the tube 124 of the collar 124 and the discontinuation of the one second opposing side wall 84 of the collar 76 to compress and secure the collar 76 around the post 18, and when done, the handle 134 of the grip 132 of the collar 76 is turned until it abuts against the far point 130 of the tube 124 of the collar 76, and when done, an outward pressure is created on the handle 134 of the grip 132 of the collar 76 that prevents the grip 132 of the collar 76 from unintentional rotation.

The nut 140 of the grip 132 of the collar 76 is an acorn nut so as to completely cover the free end 138 of the screw 136 of the collar 76 and prevent the free end 138 of the screw 136 of the collar 76 from injuring anyone unintentionally engaging it.

It will be understood that each of the elements described above, or two or more together, may also find a useful application in other types of constructions differing from the types described above.

While the invention has been illustrated and described as embodied in a device for training a martial artist to kick, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for training a martial artist to kick, comprising:

a) a stand; and b) a target extending adjustably outwardly from said stand;

wherein said stand is for extending upwardly from a floor; and wherein said target is for kicking by the martial artist so as to train the martial artist to kick, wherein said stand comprises a base;

wherein said stand comprises a post that extends replaceably upwardly from said base of said stand; and wherein said base of said stand is for resting on the floor, wherein said base of said stand comprises a first member;

wherein said first member of said base is slender;

wherein said first member of said base is elongated;

wherein said first member of said base is rectangular-parallelepiped-shaped; and wherein said first member of said base is for resting on the floor, wherein said first member of said base has a lowermost surface;

wherein said first member of said base has a pair of side surfaces;

wherein said first member of said base has a height;

wherein said first member of said base has an uppermost surface;

wherein said lowermost surface of said first member of said base is horizontally-oriented;

wherein said lowermost surface of said first member of said base is for resting on the floor;

wherein said pair of side surfaces of said first member of said base are vertically-oriented;

wherein said pair of side surfaces of said first member of said base extend upwardly from said lowermost surface of said first member of said base; and wherein said uppermost surface of said first member of said base is horizontally-oriented, wherein one side surface of said first member of said base has a pair of terminal ends;

wherein said one side surface of said first member of said base has a center; and wherein said center of said one side surface of said first member of said base is located midway between said pair of terminal ends of said one side surface of said first member of said base, wherein said first member of said base has a groove; and wherein said groove in said first member of said base is disposed in said center of said one side surface of said first member of said base, wherein said groove in said first member of said base is vertically-oriented;

wherein said groove in said first member of said base is rectangular-parallelepiped-shaped; and wherein said groove in said first member of said base has a width, wherein said top surface of said first member of said base has a pair of terminal ends;

wherein said too surface of said first member of said base has a center; and wherein said center of said top surface of said first member of said base is located midway between said pair of terminal ends of said first member of said base, wherein said first member of said base has a tongue; and wherein said tongue on said first member of said base extends upwardly from said center of said top surface of said first member of said base, wherein said tongue on said first member of said base extends horizontally from flush with said groove in said first member of said base, to short of the other side surface of said first member of said base.

2. The device as defined in claim 1, wherein said base of said stand is T-shaped.

3. The device as defined in claim 1, wherein said groove in said first member of said base extends vertically from, and opens into, said lowermost surface of said first member of said base, to, and opens into, said uppermost surface of said first member of said base; and wherein said groove in said first member of said base extends horizontally to midway between said pair of side surface of said first member of said base.

4. The device as defined in claim 1, wherein said tongue on said first member of said base is vertically-oriented;

wherein said tongue on said first member of said base is rectangular-parallelepiped-shaped;

wherein said tongue on said first member of said base has a width;

wherein said tongue on said first member of said base has a height; and wherein said tongue on said first member of said base has a depth.

5. The device as defined in claim 1, wherein said width of said tongue on said first member of said base is equal to said width of said groove in said first member of said base.

6. The device as defined in claim 1 wherein said base of said stand comprises a second member;

wherein said second member of said base is slender;

wherein said second member of said base is elongated;

wherein said second member of said base is rectangular-parallelepiped-shaped; and wherein said second member of said base is for resting on the floor.

7. The device as defined in claim 6, wherein said second member of said base has a lowermost surface;

wherein said second member of said base has a pair of side surfaces;

wherein said second member of said base has an uppermost surface;

wherein said second member of said base has a width;

wherein said second member of said base has a height;

wherein said second member of said base has a pair of ends;

wherein said lowermost surface of said second member of said base is horizontally-oriented;

wherein said lowermost surface of said second member of said base is for resting on the floor;

wherein said pair of side surfaces of said second member of said base are vertically-oriented;

wherein said pair of side surfaces of said second member of said base extend upwardly from said lowermost surface of said second member of said base; and wherein said uppermost surface of said second member of said base is horizontally-oriented.

8. The device as defined in claim 7, wherein said width of said second member of said base is equal to said width of said groove in said first member of said base.

9. The device as defined in claim 7, wherein said height of said second member of said base is equal to said height of said groove in said first member of said base.

10. The device as defined in claim 7, wherein said top surface of said second member of said base has a pair of terminal ends.

11. The device as defined in claims 10, wherein said second member of said base has a tongue; and wherein said tongue on said second member of said base extends upwardly from one terminal end of said top surface of said second member of said base.

12. The device as defined in claim 11, wherein said tongue on said second member of said base is vertically-oriented;

wherein said tongue on said second member of said base is rectangular-parallelepiped-shaped;

wherein said tongue on said second member of said base has a width;

wherein said tongue on said second member of said base has a height; and wherein said tongue on said second member of said base has a depth.

13. The device as defined in claim 11, wherein said tongue on said second member of said base extends horizontally from one side surface of said second member of said base, to the other side surface of said second member of said base; and wherein said tongue on said second member of said base is flush with one end of said second member of said base.

14. The device as defined in claim 12, wherein said width of said tongue on said second member of said base is equal to said width of said tongue on said first member of said base.

15. The device as defined in claim 12, wherein said height of said tongue on said second member of said base is equal to said height of said tongue on said first member of said base.

16. The device as defined in claim 12, wherein said depth of said tongue on said second member of said base is equal to said depth of said tongue on said first member of said base.

17. The device as defined in claim 12, wherein said one end of said second member of said base replaceably enters into, and fills completely, said groove in said first member of said base so as to allow said second member of said base to be perpendicular to, and form an intersection point with, said first member of said base, and in so doing, abuts said tongue on said second member of said base flush with said tongue on said first member of said base so as to form a combination tongue, and when done, said tongue on said second member of said base extends to short of said one side surface of said first member of said base an amount equal to that that said tongue on said first member of said base extends short of said other side surface of said first member of said base, and in so doing, centers said combination tongue, by virtue of said groove in said first member of said base extending halfway into said first member of said base, said tongue on said first member of said base extending therefrom to short of said other side surface of said first member of said base, and said depth of said tongue on said first member of said base being equal to said depth of said tongue on said second member of said base.

18. The device as defined in claim 17, wherein said post of said stand extends replaceably upwardly from said intersection point of said base.

19. A device for training a martial artist to kick, comprising:

a) a stand; and b) a target extending adjustably outwardly from said stand;

wherein said stand is for extending upwardly from a floor; and wherein said target is for kicking by the martial artist so as to train the martial artist to kick, wherein said stand comprises a base;

wherein said stand comprises a post that extends replaceably upwardly from said base of said stand; and wherein said base of said stand is for resting on the floor, wherein said post of said stand has a lowermost end;

wherein said post of said stand has a first pair of opposing side surfaces;

wherein said post of said stand has a second pair of opposing side surfaces;

wherein said lowermost end of said post is horizontally-oriented;

wherein said first pair of opposing side surfaces of said post are vertically-oriented;

wherein said first pair of opposing side surfaces of said post extend upwardly from said lowermost end of said post;

wherein said second pair of opposing side surfaces of said post are vertically-oriented;

wherein said second pair of opposing side surfaces of said post extend upwardly from said lowermost end of said post; and wherein said second pair of opposing side surfaces of said post are perpendicular to said first pair of opposing surfaces of said post, wherein said lowermost end of said post has a throughslot; and wherein said throughslot in said lowermost end of said post extends through said second pair of opposing side surfaces of said post, approximately midway between said first pair of opposing side surfaces of said post.

20. The device as defined in claim 19, wherein said post of said stand is slender;

wherein said post of said stand is elongated;

wherein said post of said stand is rectangular-parallelepiped-shaped; and wherein said post of said stand extends upwardly from said base of said stand.

21. The device as defined in claim 19, wherein said lowermost end of said post is hollow so as to receive said combination tongue, and when done, said post extends vertically upwardly from said base.

22. A device for training a martial artist to kick, comprising:

a) a stand; and b) a target extending adjustably outwardly from said stand;

wherein said stand is for extending upwardly from a floor; and wherein said target is for kicking by the martial artist so as to train the martial artist to kick, wherein said stand comprises a base;

wherein said stand comprises a post that extends replaceably upwardly from said base of said stand; and wherein said base of said stand is for resting on the floor, wherein said post of said stand has a lowermost end;

wherein said post of said stand has a first pair of opposing side surfaces;

wherein said post of said stand has a second pair of opposing side surfaces;

wherein said lowermost end of said post is horizontally-oriented;

wherein said first Pair of opposing side surfaces of said post are vertically-oriented;

wherein said first pair of opposing side surfaces of said post extend upwardly from said lowermost end of said post;

wherein said second pair of opposing side surfaces of said post are vertically-oriented;

wherein said second pair of opposing side surfaces of said post extend upwardly from said lowermost end of said post; and wherein said second pair of opposing side surfaces of said post are perpendicular to said first pair of opposing surfaces of said post, wherein said post has a tube;

wherein said tube of said post is affixed across one second opposing side surface of said post; and wherein said tube of said post extends, at one end thereof, from flush with one first opposing side surface of said post, to, at a free end thereof, just past the other first opposing side surface of said post.

23. The device as defined in claim 22, wherein said free end of said tube is skewed so as to have a far point.

24. The device as defined in claim 23, wherein said post has a grip;

wherein said grip of said post is slender;

wherein said grip of said post is elongated; and wherein said grip of said post is L-shaped.

25. The device as defined in claim 22, wherein said grip of said post has a handle;

wherein said grip of said post has a screw; and wherein said screw of said grip of said post is perpendicular to said handle of said grip of said post.

26. The device as defined in claim 25, wherein said screw of said grip of said post extends freely into said tube of said post, from said free end of said tube, to past said one end of said tube, and at a free end thereof, engages a nut, and when said lowermost end of said post receives said combination tongue, and said handle of said grip of said post is free of said far point of said tube, said nut of said grip of said post is tightened causing said throughslot in said post to compress and secure said post onto said base, and when done, said handle of said grip of said post is turned until it abuts against said far point of said tube, and when done, an outward pressure is created on said handle of said grip of said post that prevents said grip of said post from unintentional rotation.

27. The device as defined in claims 26, wherein said nut of said grip of said post is an acorn nut so as to completely cover said free end of said screw and prevent said free end of said screw from injuring anyone unintentionally engaging it.

28. The device as defined in claim 22, wherein said target comprises a collar;

wherein said target comprises at least one bag;

wherein said collar of said target conformingly encircles said post of said stand; and wherein said at least one bag extends radially outwardly from said collar of said target.

29. The device as defined in claim 28, wherein said collar of said target is a slender band.

30. The device as defined in claim 28, wherein said collar of said target has a first pair of opposing side walls;

wherein said first pair of opposing side walls of said collar are horizontally-oriented;

wherein said first pair of opposing side walls of said collar directly contact said first pair of opposing side surfaces of said post, respectively;

wherein said collar of said target has a second pair of opposing side walls;

wherein said second pair of opposing side walls of said collar are horizontally-oriented;

wherein said second pair of opposing side walls of said collar directly contact said second pair of opposing side surfaces of said post, respectively; and wherein said second pair of opposing side walls of said collar are perpendicular to said first pair of opposing walls of said collar.

31. The device as defined in claim 30, wherein one second opposing side wall of said collar that is in direct contact with said one second opposing side surface of said post is discontinuous so as to form a discontinuation.

32. The device as defined in claim 30, wherein said collar of said target has a first pair of brackets;

wherein said first pair of brackets of said collar are horizontally-oriented;

wherein said first pair of brackets of said collar are C-shaped; and wherein said first pair of brackets of said collar extend outwardly from, and across, at transverse portions thereof, said first pair of opposing side walls of said collar, respectively.

33. The device as defined in claim 32, wherein said transverse portions of said first pair of brackets have throughbores, respectively; and wherein said throughbores in said transverse portions of said first pair of brackets extend centrally therethrough.

34. The device as defined in claim 33, wherein said collar of said target has a second bracket;

wherein said second bracket of said collar is horizontally-oriented;

wherein said second bracket of said collar is C-shaped; and wherein said second bracket of said collar extends outwardly from, and across, at a transverse portion thereof, the other second opposing side wall of said collar.

35. The device as defined in claim 34, wherein said transverse portion of said second bracket has a throughbore; and wherein said throughbore in said transverse portion of said second bracket extends centrally therethrough.

36. The device as defined in claim 31, wherein said collar has a tube;

wherein said tube of said collar is discontinuous so as to form a discontinuation;

wherein said tube of said collar is affixed across said one second opposing side wall of said collar; and wherein said tube of said collar extends, at one end thereof, from flush with one first opposing side wall of said collar, to, at a free end thereof, just past the other first opposing side wall of said collar.

37. The device as defined in claim 36, wherein said discontinuation of said tube of said collar is aligned with said discontinuation of said one second opposing side wall of said collar.

38. The device as defined in claim 36, wherein said free end of said tube of said collar is skewed so as to have a far point.

39. The device as defined in claim 38, wherein said collar has a grip;

wherein said grip of said collar is slender;

wherein said grip of said collar is elongated; and wherein said grip of said collar is L-shaped.

40. The device as defined in claim 39, wherein said grip of said collar has a handle;

wherein said grip of said collar has a screw; and wherein said screw of said grip of said collar is perpendicular to said handle of said grip of said collar.

41. The device as defined in claim 40, wherein said screw of said grip of said collar extends freely into said tube of said collar, from said free end of said tube of said collar, to past said one end of said tube of said collar, and at a free end thereof, engages a nut, and when said collar receives said post, and said handle of said grip of said collar is free of said far point of said tube of said collar, said nut of said grip of said collar is tightened causing said discontinuation of said tube of said collar and said discontinuation of said one second opposing side wall of said collar to compress and secure said collar around said post, and when done, said handle of said grip of said collar is turned until it abuts against said far point of said tube of said collar, and when done, an outward pressure is created on said handle of said grip of said collar that prevents said grip of said collar from unintentional rotation.

42. The device as defined in claim 41, wherein said nut of said grip of said collar is an acorn nut so as to completely cover said free end of said screw of said collar and prevent said free end of said screw of said collar from injuring anyone unintentionally engaging it.

43. The device as defined in claim 34, wherein said at least one bag of said target extends from any one of said first pair of brackets of said collar and said second bracket, and when said at least one bag of said target is more than one, said more than one bag of said target extend from any combination of said first pair of brackets of said collar and said second bracket, respectively.

44. The device as defined in claim 35, wherein said at least one bag of said target comprises a first fastener;

wherein said first fastener of said at least one bag is horizontally-oriented; and wherein said first fastener of said at least one bag extends radially outwardly through an associated one of said throughbore in each of said first pair of brackets and said throughbore in said second bracket, and is prevented from extending completely therethrough by a head of said first fastener.

45. The device as defined in claim 44, wherein said at least one bag of said target comprises a coil spring; and wherein said coil spring of said at least one bag is affixed, at a first end thereof, to said first fastener of said at least one bag.

46. The device as defined in claim 45, wherein said at least one bag of said target comprises a second fastener; and wherein said second fastener of said at least one bag is affixed to, and extends axially from, a second end of said coil spring.

47. The device as defined in claim 46, wherein said second fastener of said at least one bag has a throughbore; and wherein said throughbore through second fastener extends transversely therethrough.

48. The device as defined in claim 47, wherein said at least one bag of said target comprises a coupling;

wherein said coupling of said at least one bag is tubular; and wherein said coupling of said at least one bag receives axially, at a first end thereof, said second fastener of said at least one bag, and extends axially therefrom, to a second end thereof.

49. The device as defined in claim 48, wherein said coupling of said at least one bag has a throughbore;

wherein said throughbore in said coupling extends transversely therethrough; and wherein said throughbore in said coupling is aligned with said throughbore in said second fastener of said at least one bag.

50. The device as defined in claim 49, wherein said second fastener of said at least one bag is selectively maintained in said first end of said coupling of said at least one bag by a pin; and wherein said pin replaceably enters into said throughbore in said coupling of said at least one bag and said throughbore in said second fastener of said at least one bag.

51. The device as defined in claim 48, wherein said at least one bag comprises a rod;

wherein said rod of said at least one bag has a first end; and wherein said first end of said rod is affixed in, for movement with, said second end of said coupling of said at least one bag.

52. The device as defined in claim 51, wherein said rod of said at least one bag extends axially from said coupling of said at least one bag.

53. The device as defined in claim 51, wherein said at least one bag comprises a cushion;

wherein said cushion of said at least one bag is cylindrically-shaped; and wherein said cushion of said at least one bag axially receives said rod of said at least one bag centrally therethrough for movement therewith.

54. The device as defined in claim 53, wherein said cushion of said at least one bag is spaced from said coupling of said at least one bag.

55. The device as defined in claim 53, wherein said cushion of said at least one bag is completely encased in a covering; and wherein said covering of said at least one bag conforms to said cushion of said at least one bag.

56. The device as defined in claim 55, wherein said covering of said cushion is made of a fabric.

57. The device as defined in claim 55, wherein said covering of said cushion is replaceably maintained on said cushion of said at least one bag by a pull cord.

* * * * *